US006853819B2

(12) United States Patent
Sugita

(10) Patent No.: US 6,853,819 B2
(45) Date of Patent: Feb. 8, 2005

(54) IMAGE FORMING APPARATUS WITH MOUNTABLE AND DISMOUNTABLE ELECTRIC COMPONENT UNIT

(75) Inventor: Satoshi Sugita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/351,993

(22) Filed: Jan. 28, 2003

(65) Prior Publication Data

US 2003/0156854 A1 Aug. 21, 2003

(30) Foreign Application Priority Data

Jan. 29, 2002 (JP) ..... 2002-019653

(51) Int. Cl.[7] ..... G03G 15/00
(52) U.S. Cl. ..... 399/90
(58) Field of Search ..... 399/90, 89, 88, 399/107, 92, 93

(56) References Cited

U.S. PATENT DOCUMENTS 5,001,602 A * 3/1991 Suffi et al. ..... 361/390
5,235,494 A * 8/1993 Chang et al. ..... 361/736
5,918,089 A * 6/1999 Malinich et al. ..... 399/90

* cited by examiner

*Primary Examiner*—Quana Grainger
(74) *Attorney, Agent, or Firm*—Fitzpatrick, Cella, Harper & Scinto

(57) ABSTRACT

The present invention provides an image forming apparatus including an apparatus main body having a contact, and an electric component unit mountable and dismountable with respect to the apparatus main body, and wherein the electric component unit has a circuit substrate, and a contact electrically connected to the circuit substrate, and further including a guide portion for guiding a movement of the electric component unit when the electric component unit is mounted to the apparatus main body, and further wherein, when the electric component unit is mounted to the apparatus main body, the contact of the electric component unit is electrically connected to the contact of the apparatus main body by guiding the movement of the electric component unit by means of the guide portion.

8 Claims, 14 Drawing Sheets

IMAGE FORMING APPARATUS WITH MOUNTABLE AND DISMOUNTABLE ELECTRIC COMPONENT UNIT

BACKGROUND OF THE INVENTION

1. Field of the Invention

The present invention relates to an image forming apparatus such as a printer, a copier, a printing machine and the like using electro-photographic process, and more particularly, it relates to an improvement in a disassembling/assembling ability of electric component units to an apparatus main body and an improvement in contact connections.

2. Related Background Art

A construction of a conventional image forming apparatus will now be described with reference to FIGS. 13 and 14. FIG. 13 is a view for explaining a condition that a conventional high voltage unit is incorporated into an apparatus main body, and FIG. 14 is a view for explaining an assembled construction of the conventional high voltage unit and a drive unit.

An image forming apparatus shown in FIG. 13 is a four-color printer using electro-photographic process and includes image forming portions 901Y, 901M, 901C and 901K for yellow, magenta, cyan and black colors, respectively. These image forming portions 901M to 901K are incorporated into a drive unit 902 having high voltage bias applying means. The drive unit 902 includes gears for driving electrifying means, developing means, photosensitive drums and drive rollers of intermediate transferring belts (all are not shown) provided in the image forming portions 901Y to 901K, and, in the illustrated embodiment, the drive unit forms a part of a frame of the main body.

The drive unit 902 receives an electric power from a high voltage unit 903 as an electric component unit. The high voltage unit 903 has a high voltage circuit substrate and has contacts to be connected to the main body frame side within the image forming apparatus. The high voltage unit 903 is connected to a power supply unit 904 for supplying power to various parts of the image forming apparatus and a record controlling system 905 of the image forming apparatus. Incidentally, in the drawings, to clarify the understanding, wires between the electric component units are omitted from illustration. Further, contact portions 906Y to 906K of the high voltage unit 903 are contacted with high voltage connection portions of the drive unit 902 with predetermined pressure, thereby transmitting the electric power.

Next, connection between the drive unit 902 and the high voltage unit 903 is illustrated in FIG. 14 in detail. The high voltage unit 903 is positioned with respect to the drive unit 902 so that bosses and holes are fitted together at positioning portions 907 and 908 and a contact spring 909 of the high voltage unit 903 is contacted with a contact plate 910 of the drive unit 902 with predetermined contact pressure. Further, a contact spring 912 to a secondary transferring contact plate 911 of a secondary transferring portion (not shown) is provided on a back surface of the high voltage unit 903. Furthermore, independently from the positioning, the high voltage unit 903 is secured to the main body frame by fastening means such as screws at attachment portions 913 to 916.

However, in the image forming apparatus having the above-mentioned construction, when the high voltage unit 903 is attached, if the positioning portions 907 and 908 are tried to be aligned, since the electric component unit is not supported at all, the unit becomes unstable and is frequently supported with inclination toward directions 803 and 804, and, thus, there arose a problem that it is very difficult to align to the positioning portions 907 and 908. Under such a condition that the positioning is difficult, if the high voltage unit 903 tries to be forcibly assembled, as it is, the contact spring 909 may ride on the opposite surface of the contact plate 910 or the contact spring 909 itself may be buckled from its tip end to deform and/or damage the contact spring.

In order to avoid the above problem, although there has been proposed an arrangement in which a coil spring (not shown) is incorporated so that is expanded and contracted in an acting direction (up-and-down direction in FIG. 14), since the horizontal positioning of the high voltage unit 903 is insufficient, there frequently arose inconvenience that the coil spring rides on a member between the contacts.

Further, although the high voltage circuit substrate of the high voltage unit 903 can be assembled as a unit, in a case where the substrate has a laminated construction, when high voltage output is provided on the substrate at a position farthest from the high voltage connection portion of the drive unit 902, there arose a disadvantage, in design, that wiring of a cable and the like such as high voltage introducing means to the main body becomes very complicated and difficult. Further, when the connection of the high voltage unit 903 tries to be effected positively, in view of reliability, a press-contact terminal may be used in place of the contact spring 909. If doing so, the circuit substrate must be assembled to the frame directly in the main body assembling line, with the result that it is very difficult to assemble the circuit substrate and peripheral portions thereof as a unit, and the assembling cost and disassembling cost are increased considerably (although an adequate function can be achieved).

SUMMARY OF THE INVENTION

A first object of the present invention is to provide an image forming apparatus in which an assembling ability and disassembling facilitation of an electric component unit such as a high voltage unit and the like having contact connection are enhanced.

A second object of the present invention is to provide an image forming apparatus comprising an apparatus main body having a contact, an electric component unit detachable to the apparatus main body and having a circuit substrate and a contact electrically connected to the circuit substrate, and guide means for guiding movement of the electric component unit when the electric component unit is mounted to the apparatus main body, and wherein, when the electric component unit is mounted to the apparatus main body, the contact of the electric component unit is electrically connected to the contact of the apparatus main body by guiding the movement of the electric component unit by means of the guide means.

A third object of the present invention is to provide an image forming apparatus comprising an apparatus main body having a contact, an electric component unit detachable to the apparatus main body and having a circuit substrate and a plurality of contacts electrically connected to the circuit substrate, and connecting means for electrically connecting the plural contacts of the electric component unit to the contact of the apparatus main body at same timing.

A fourth object of the present invention is to provide an image forming apparatus comprising an apparatus main body, and an electric component unit detachable to the apparatus main body and having a plurality of laminated circuit substrate and a frame including the circuit substrates therein, and wherein the frame can be divided in a laminating direction of the plural circuit substrates, and, between at least two circuit substrates, when the frame is divided, the contacts of the circuits are released, and, when the frame is assembled, the contacts of the circuits are formed.

The other objects of the invention will be apparent from the following detailed explanation.

DESCRIPTION OF THE PREFERRED EMBODIMENTS

The present invention will now be fully explained in connection with preferred embodiments thereof as examples. However, it should be noted that sizes, materials, configurations and relative positions of constructural parts described in the preferred embodiments can be appropriately changed in accordance with an apparatus and various conditions to which the present invention is applied, and the present invention is not intended to be limited to the embodiments described hereinbelow.

[First Embodiment]

Figure 1:
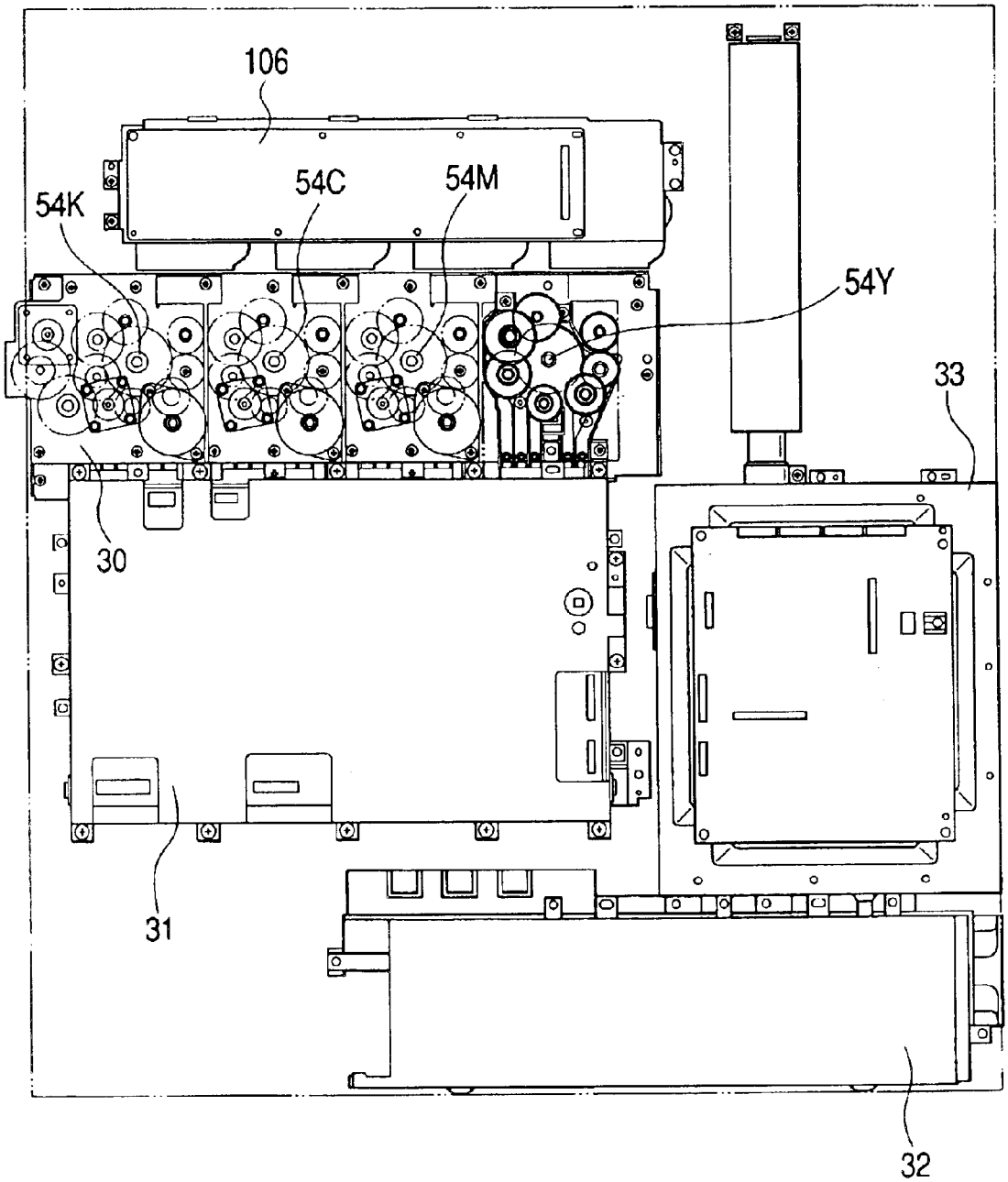
FIG. 1 is a view for explaining a condition that a high voltage unit is assembled to an apparatus main body, according to a first embodiment of the present invention.
Figure 2:
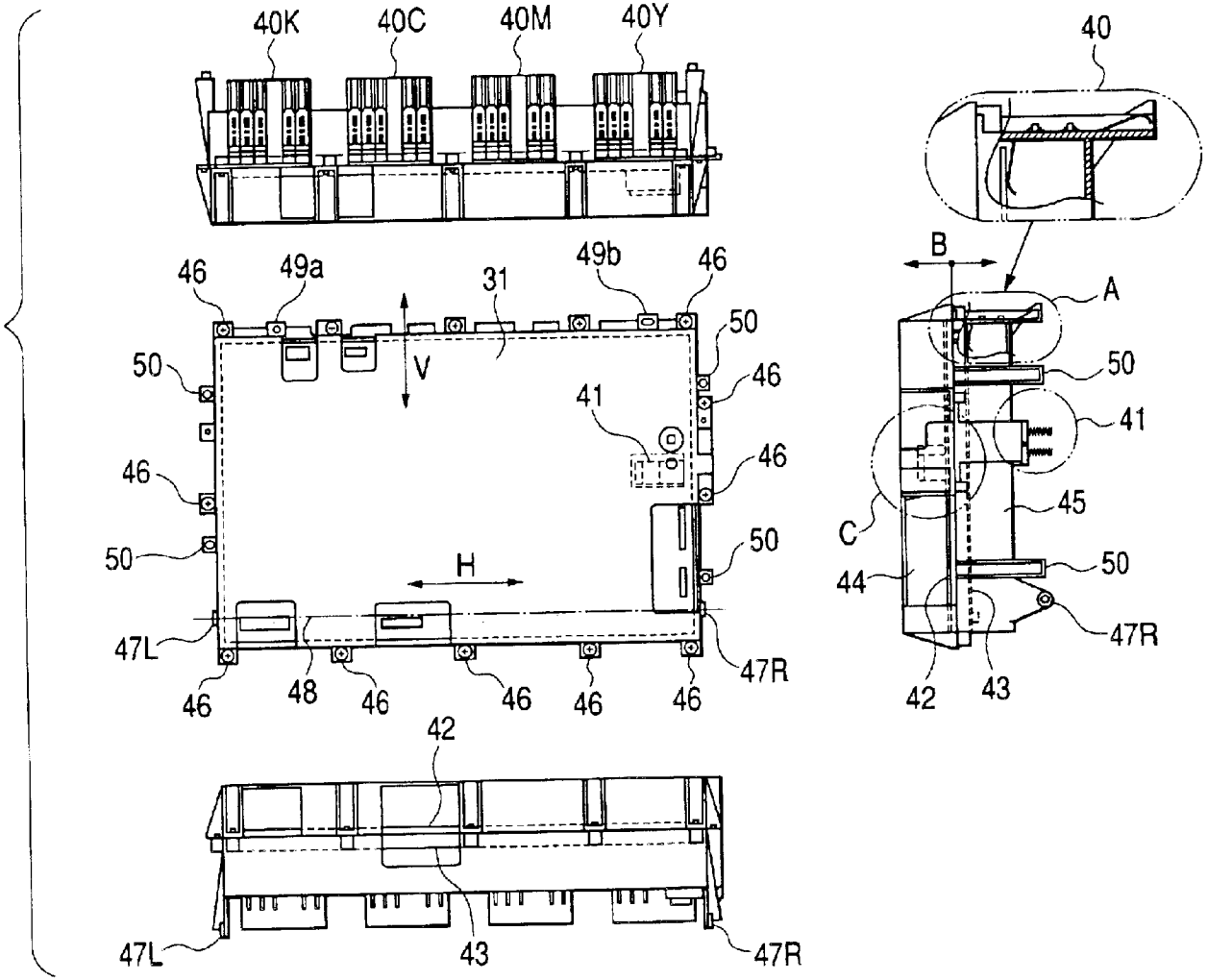
FIG. 2 is a view showing the high voltage unit according to the first embodiment.
Figure 3:
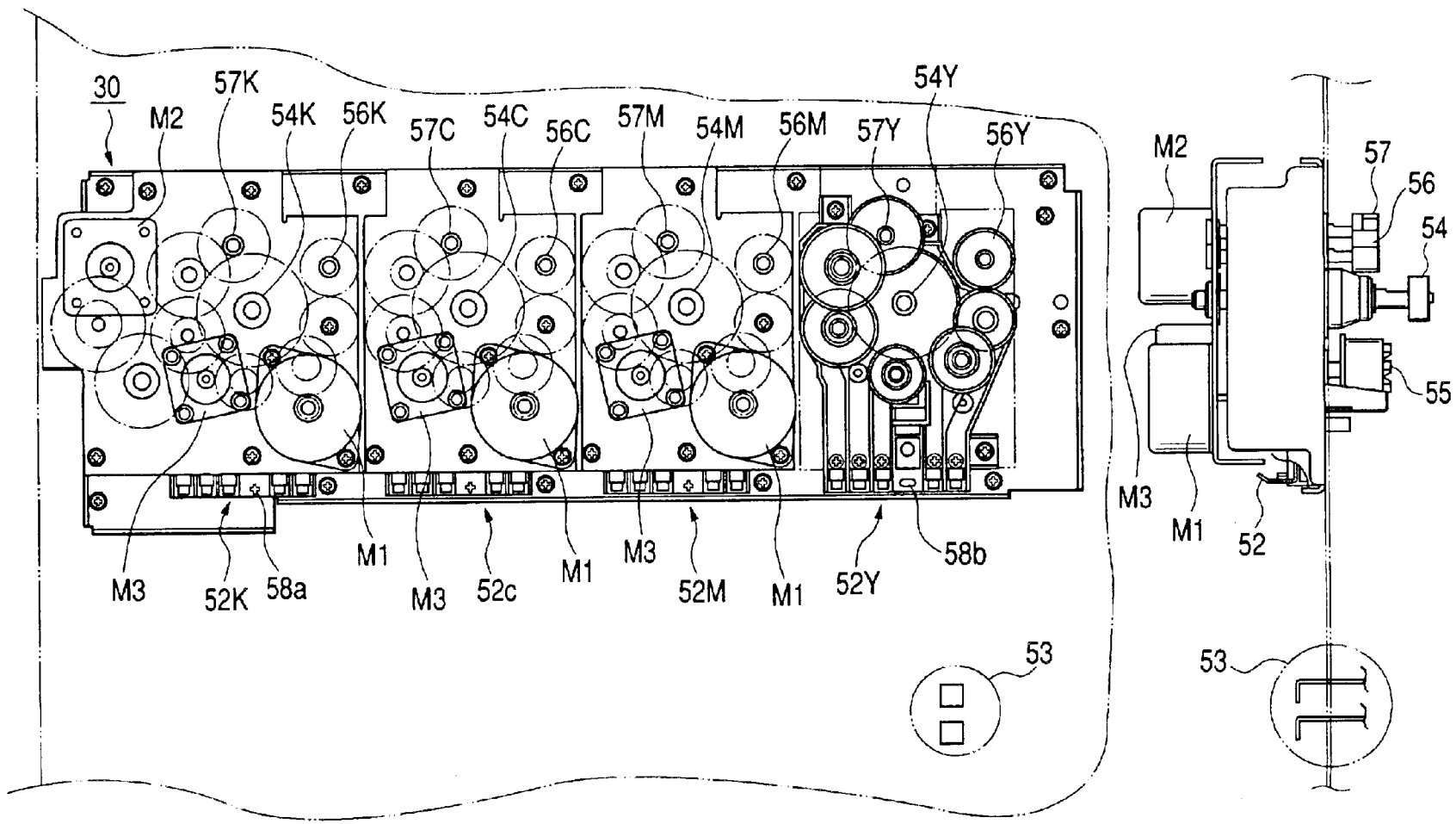
FIG. 3 is a constructural view of a drive unit.
Figure 4:
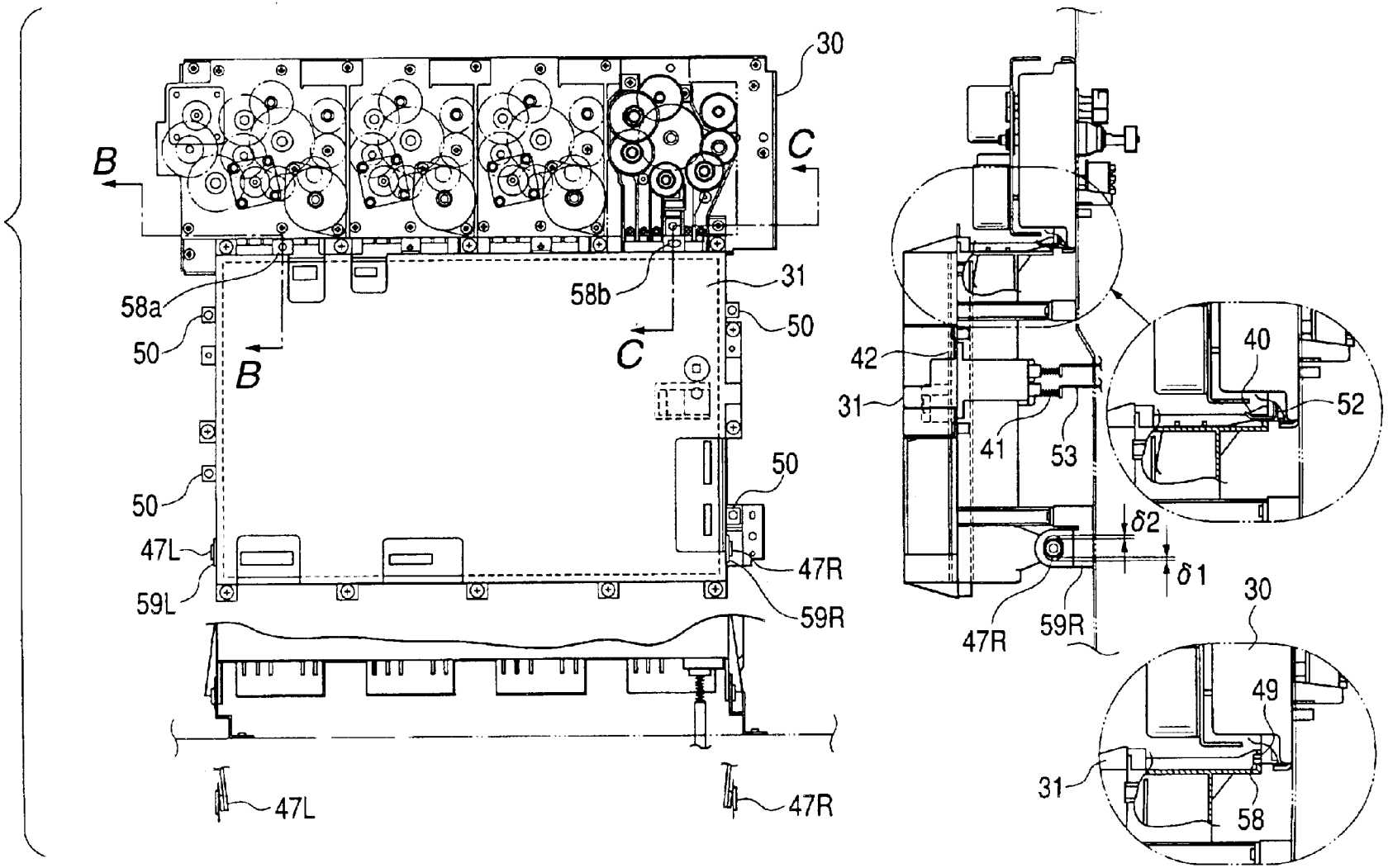
FIG. 4 is a view for explaining an assembled construction of the high voltage unit and the drive unit.
Figure 5A:
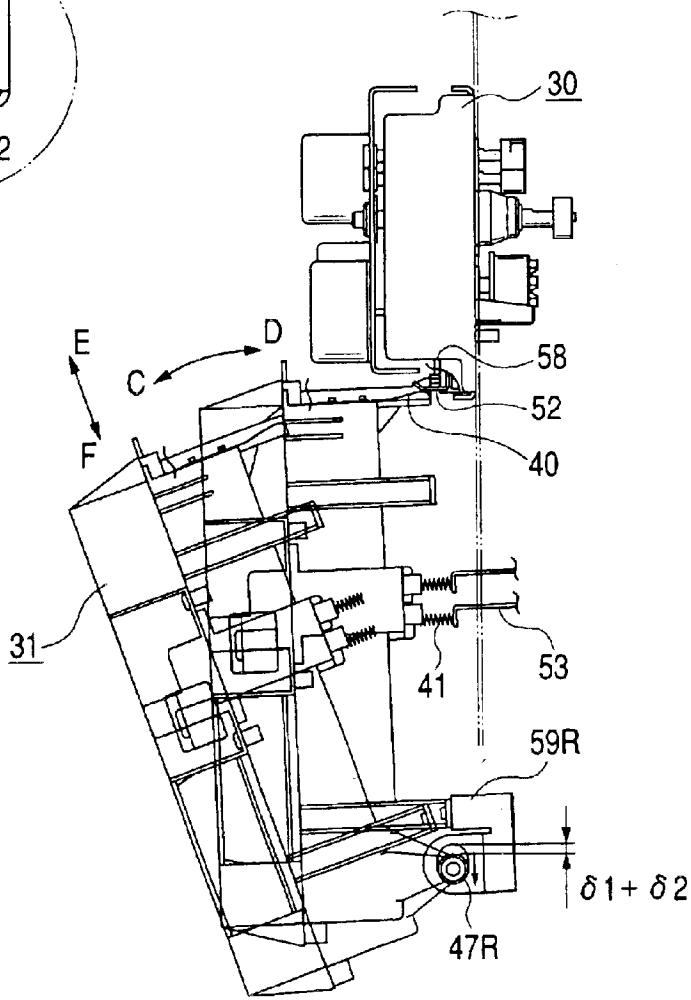
FIGS. 5A and 5B are views for explaining mounting/dismounting operation gist of the high voltage unit to the apparatus main body.
Figure 5B:
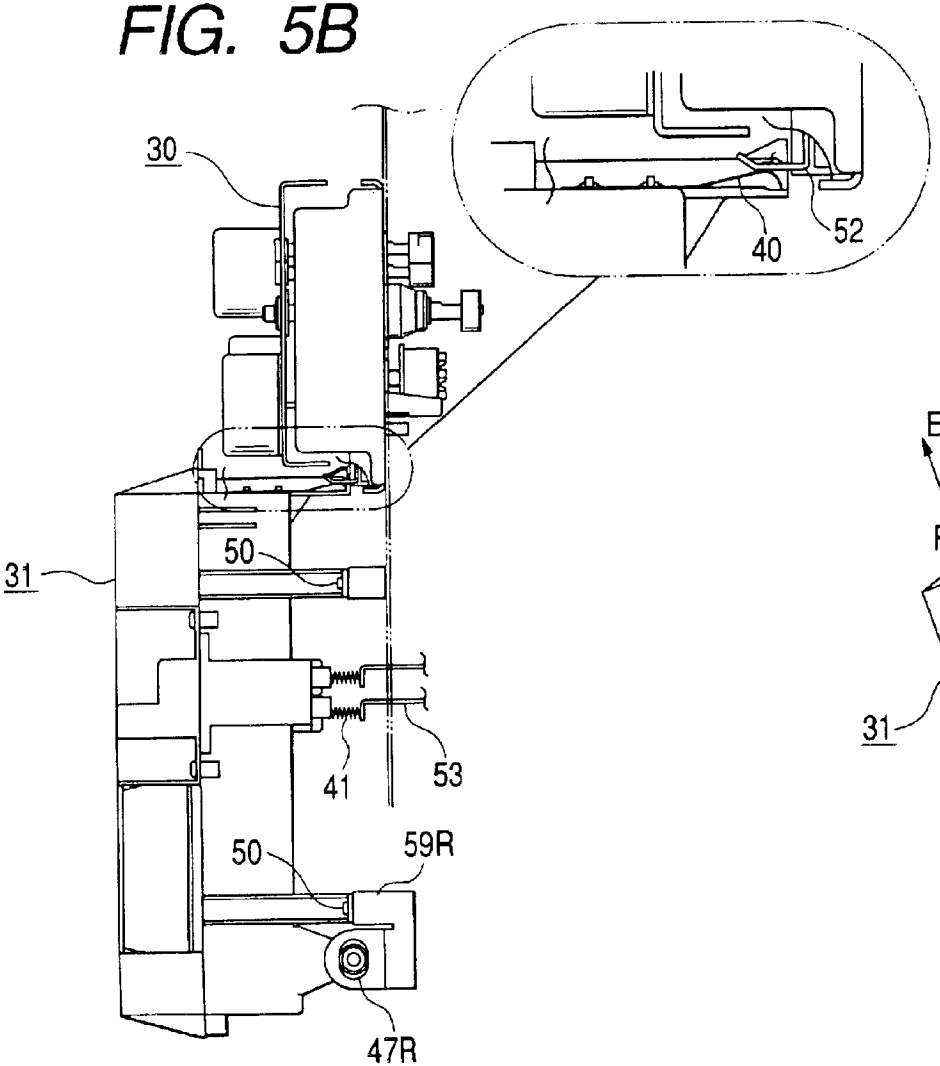
Figure 6:
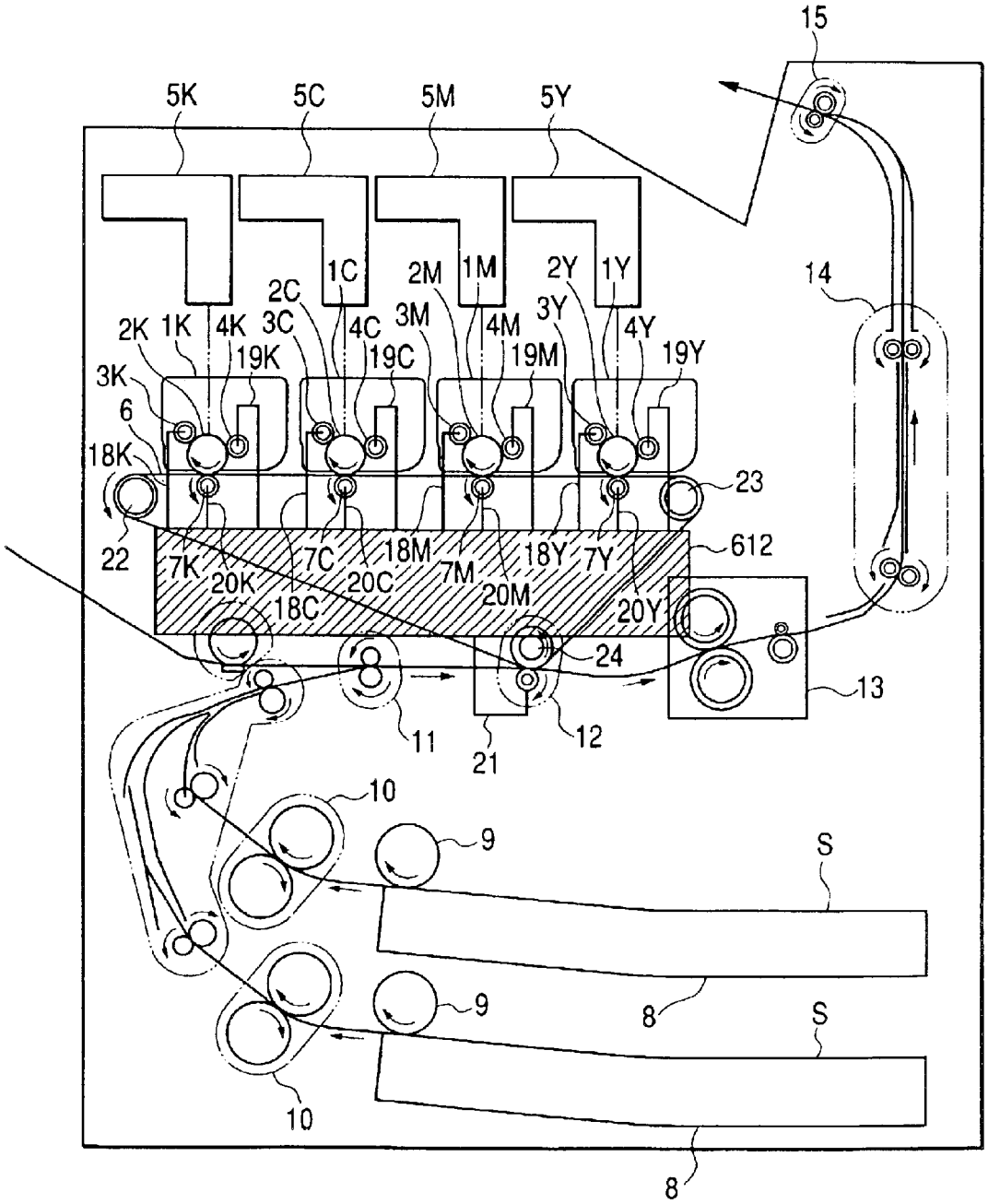
FIG. 6 is an entire constructural view of an image forming apparatus according to the first embodiment.

A first embodiment of an image forming apparatus according to the present invention will be explained with reference to the drawings. FIG. 1 is a view for explaining an assembled condition of a high voltage unit to an apparatus main body, according to the first embodiment, FIG. 2 is a view showing the high voltage unit according to the first embodiment, FIG. 3 is a constructural view of a drive unit, FIG. 4 is a view for explaining an assembled construction of the high voltage unit and the drive unit, FIGS. 5A and 5B are views for explaining a mounting/dismounting operation gist of the high voltage unit with respect to the apparatus main body, and FIG. 6 is a view showing an entire construction of the image forming apparatus according to the first embodiment.

(Entire Construction of Image Forming Apparatus)

First of all, an entire construction of the image forming apparatus will be described with reference to FIG. 6. In the first embodiment, the image forming apparatus is a four color printer using electro-photographic process and has image forming portions 1Y, 1M, 1C and 1K for effecting image formation. Y, M, C and K are abbreviation or short for primary colors used in the image formation and mean yellow, magenta, cyan and black, respectively (hereinafter, when these colors are distinguished, added marks Y to K or Y to K are used). In image forming portions 1, photosensitive drums 2Y to 2K as image bearing members are uniformly electrified by electrifying rollers 3Y to 3K as electrifying means, and electrostatic latent images are formed by exposing the drums with laser beams by optical means 5Y to 5K. The electrostatic latent images are developed with toners by developing sleeves 4Y to 4K as developing means, thereby forming toner images.

The respective image forming portions 1Y to 1K abut against an intermediate transferring belt 6, and the toner images on the photosensitive drums 2 are transferred onto the intermediate transferring belt 6 in a superimposed fashion by primary transferring rollers 7Y to 7K disposed within the intermediate transferring belt 6. On the other hand, sheets S as transferring materials housed in a feeding cassette 8 are separated one by one by means of a feeding roller 9 and a pair of separation rollers 10, and the separated sheet is conveyed by a pair of registration rollers 11 in synchronous with the toner images on the intermediate transferring belt 6. After the toner images on the intermediate transferring belt 6 are transferred onto the sheet S by a secondary transferring roller 12, the sheet is conveyed to a fixing device 13, where heat and pressure are applied so that images are fixed. The sheet S on which the images were fixed is discharged out of the apparatus by means of a pair of conveying rollers 14 and a pair of discharging rollers 15.

In the image forming portions, high voltages are applied to the electrifying rollers 3Y to 3K from the high voltage unit by means of electrifying bias applying means 18Y to 18K, and, similarly, high voltages are applied to the developing sleeves 4Y to 4K by means of developing bias applying means 19Y to 19K and high voltages are applied to the primary transferring rollers 7Y to 7K by means of primary transferring bias applying means 20Y to 20K. Further, the intermediate transferring belt 6 is maintained under tension by a drive roller 22, a driven roller 23 and a tension roller 24, and high voltage is applied to the secondary transferring roller 12 opposed to the tension roller 24 by secondary transferring bias applying means 21. Such bias applying means each utilizes contact connection construction.

(Electric Component Unit)

Next, electric component units provided in the image forming apparatus will be described. As shown in FIG. 1, the image forming apparatus includes electric component units for supplying electric signals, such as a drive unit 30 having the image forming portions 1Y to 1K, a high voltage unit 31 for supplying an electric power to the drive unit, a power supply unit 32 for supplying operating electric powers to other units, a record controlling system unit 33 for emitting instruction for image formation in accordance with an image input signal and the like. Incidentally, in FIG. 1, in order to clarify the understanding, wirings to the drive unit and various electric component units are omitted from illustration.

(High Voltage Unit)

As shown in FIG. 2, the high voltage unit 31 includes therein high voltage circuit substrates 42 and 43 and is designed to be detachable with respect to a frame of the apparatus main body. The high voltage circuit substrates 42 and 43 are secured to a first high voltage case 44 and a second high voltage case 45 which are a frame of the high voltage unit 31, respectively and these high voltage cases 44 and 45 are can be separated from a fastening portion B by dismounting fastening screws 46. High voltage contacts 40Y to 40K for supplying high voltage to the drive unit 30 are disposed on an upper surface of the high voltage unit 31, and a secondary transferring contact spring 41 for connection to a secondary transferring contact portion 53 (FIG. 3) of the secondary transferring bias applying means 21 is provided on a back surface of the high voltage unit.

The high voltage contacts 40Y to 40K are formed from springs, so that a relay contact circuit for outputting bias voltage from the high voltage circuit substrate 42 side is required, and, as shown at a portion A in FIG. 2, by fastening the high voltage cases 44 and 45, a contact circuit is formed simultaneously with the fastening assembling. By contacting the high voltage contacts 40Y to 40K with the drive unit with predetermined pressure, the electric powers are supplied to various bias applying means of the drive unit 30.

Rotary shafts 47R and 47L having substantially horizontal axes are provided at lower both ends of the high voltage unit 31. That is to say, the rotary shafts 47R and 47L are provided at a side opposite to the high voltage contacts 40 within the high voltage unit 31 and have rotary axes 48 extending to a direction (shown by the arrow H) perpendicular to a pressure acting direction (shown by the arrow V) of the high voltage contacts 40.

The high voltage unit 31 is provided at its upper end with positioning holes 49*a* and 49*b* for the drive unit, and the hole 49*a* is positioned at a positioning side and the hole 49*b* is positioned at a matching side for absorbing the manufacturing error and assembling error of parts. The positioning holes 49*a* and 49*b* are disposed in parallel with the attachment face of the high voltage contacts 40 with appropriate configuration tolerance or positional accuracy. Further, fixing portions 50 are provided on both side surfaces of the high voltage unit 31 and are secured by fixing means such as screws after the positioning of the high voltage unit 31 and contacting of various contacts are completed.

(Drive Unit)

The drive unit 30 has gears for driving the electrifying rollers 3Y to 3K, developing sleeves 4Y to 4K, photosensitive drums 2Y to 2K and the driving roller 22 of the intermediate transferring belt 6. As shown in FIG. 3, contact plates 52Y to 52K to be contacted with the high voltage contacts 40Y to 40K of the high voltage unit 31 are provided on a lower surface of the drive unit 30. In the vicinity of the both side contact plates 52Y and 52K, positioning bosses 58*a* and 58*b* are provided. Further, a secondary transferring contact portion 53 is provided below the drive unit 30 and is press-connected to the secondary transferring contact spring 41 of the high voltage unit 31.

Further, the drive unit 30 is provided with drive motors M1 for driving the photosensitive drums 2, drive couplings 54Y to 54K for transmitting driving forces of the motors, a drive motor M2 for driving the intermediate transferring belt 6, a drive coupling 55 for transmitting a driving force of the motor, drive motor M3 for driving the electrifying rollers 3 and the developing sleeves 4, and drive couplings 56Y to 56K and 57Y to 57K for transmitting driving forces of the rollers and sleeves.

(Connection between High Voltage Unit and Drive Unit)

Next, attachment of the high voltage unit having the above-mentioned construction to the apparatus main body and connection between the high voltage unit and the drive unit will be explained with reference to FIG. 4 and FIGS. 5A and 5B.

The apparatus main body is provided with rotary shaft supporting members 59R and 59L into which the rotary shafts 47R and 47L of the high voltage unit 31 are fitted. Although the high voltage unit is positioned by fitting the positioning holes 49*a* and 49*b* onto the positioning bosses 58*a* and 58*b* of the drive unit 30, as shown in FIG. 4, the rotary shaft supporting members 59R and 59L are rotatably supported with lower gap $\delta 1$ and upper gap $\delta 2$. Here, depending upon the design conditions, it may be set to be $\delta 1 = \delta 2$. Incidentally, required gaps are provided in a left-and-right direction of the fitting portion in accordance with the required design conditions. In the fitting portion, it is designed so that the fitting is completed by elastically deforming base portions of the rotary shafts 47R and 47L by engaging lock (snap fit). The reason why the upper fitting gap $\delta 2$ is also provided is that unit assembling error and part error in the up-and-down direction particularly upon the positioning of the high voltage unit are escaped, thereby achieving the correct positioning.

When the high voltage unit 31 is assembled to the apparatus main body, as shown in FIG. 5A, first of all, the high voltage unit 31 is dropped in an inclined condition (in a direction shown by the arrow F), and the rotary shafts 47R and 47L at lower both ends are fitted in the rotary shaft supporting members 59R and 59L by the engaging lock. Here, the rotary shafts 47 and the rotary shaft supporting members 59 constitute guide means for guiding the movement of the high voltage unit 31. Then, the high voltage unit 31 is rotated around the rotary shafts 47 (in a direction shown by the arrow D) to approach the high voltage unit 31 to the drive unit 30. However, since the rotary shafts 47 are deviated downwardly by an amount corresponding to the gap $\delta 1$ of the rotary shaft supporting members 59, the positioning holes 49 of the high voltage unit 31 are not just fitted onto the positioning bosses 58 of the drive unit, with the result that the holes abut against tip ends of the positioning bosses 58 thereby to stop the rotation of the high voltage unit.

Then, the high voltage unit 31 is lifted upwardly, and, as shown in FIG. 5B, positioning holes 49 are fitted onto the positioning bosses 58 to abut the high voltage contacts 40Y to 40K against the contact plates 52Y to 52K. Here, the positioning bosses 58 act as guide means for guiding the upward movement of the high voltage unit 31. In this case, the secondary transferring contact spring 41 also abuts against the secondary transferring contact portion 53. The positioning bosses 58 as the positioning means can be fitted in a direction of the press-contact acting direction of the high voltage contacts 40 and is parallel to the press-contact acting direction of the secondary transferring contact spring 41. After the assembling, contact connection and positioning with respect to the frame are completed in this way, the high voltage unit is secured to the frame of the main body by the fixing portions 50, and a series of operations are completed.

By positively supporting and guiding the movement of the high voltage unit by means of the rotary shafts and the positioning bosses as the guide means, the contacts of the high voltage unit are electrically connected to the contacts of the apparatus main body easily and positively. Further, by the connection means for electrically connecting the plurality of high voltage contacts 40Y to 40K of the high voltage unit to the contacts of the apparatus main body at the same timing, many contacts can be contacted simultaneously only by the series of mounting operations of the electric component units. With this arrangement, complicated unit assembling and main body mounting/dismounting operability can be improved greatly, and the electric component unit in which having a function for permitting the positive and simultaneous contacting of many contacts with the contacts of the frame of the main body is realized. Particularly, in the high voltage circuit substrate of the color image forming apparatus requiring the respective contacts for the respective colors, there are many advantages regarding design, production and maintenance. Further, the assembling of the electric component unit itself has less error and is very simple, and an amending operation is not required, and a construction that can be easily understood by the worker can be achieved. Accordingly, a great improving effect can be obtained in a design side and a production side. More specifically, particularly without great increase in cost, the mounting/dismounting operation time of the electric component unit can be shortened to about ½ to ⅓ (in the image forming apparatus designed by the Inventors, with the arrangement according to the present invention, average operation time required for mounting/dismounting of the unit after the various wirings are disconnected was about 3 to 5 minutes) of the conventional operation time. Further, the assembling of the electric component unit itself has less error and is very simple, and an amending operation is not required, and a construction that can be easily understood by the worker can be achieved.

When the high voltage unit 31 is dismounted from the apparatus main body and the drive unit 30, reverse operations opposite to the above-mentioned operations are performed. That is to say, after the fixing portions 50 are released, the positioning holes 49 are dismounted from the positioning bosses 58, and, as shown in FIG. 5A, the high voltage unit is rotated (in a direction shown by the arrow C). Then, the rotary shafts 47 are withdrawn from the rotary shaft supporting members 59 (in a direction shown by the arrow E), and the high voltage unit is lifted upwardly, thereby completing the separation. Incidentally, in such series of operations, the wirings to the related electric component units are previously disconnected.

Incidentally, in the illustrated embodiment, as mentioned above, the high voltage unit 31 has the plurality of laminated high voltage circuit substrates 42, 43 and the high voltage cases 44, 45 including therein the high voltage circuit substrates 42, 43, and the high voltage case can be divided into the first high voltage case 44 and the second high voltage case 45 in the laminating direction of the high voltage circuit substrates 42 and 43. With this arrangement, when the high voltage case is divided into the first high voltage case 44 and the second high voltage case 45, the high voltage circuit substrate 42 is also separated from the high voltage circuit substrate 43, with the result that the contacts between the circuits are released. Conversely, when the divided first high voltage case 44 and second high voltage case 45 are assembled together, the contacts between the circuits of the high voltage circuit substrates 42 and 43 are also formed or established. Accordingly, also in a condition that the high voltage unit 31 is attached to the apparatus main body, the contacts between the circuits can be released only by dividing the high voltage unit, with the result that each of the internal high voltage circuit substrates 42 and 43 can be mounted and dismounted safely, as is in the conventional case. Thus, if the substrate alone becomes defective, it is not required that the entire high voltage unit 31 be dismounted from the main body, and general operations such as substrate exchanging can be effected only by separating the first high voltage case 44.

[Second Embodiment]

Figure 7:
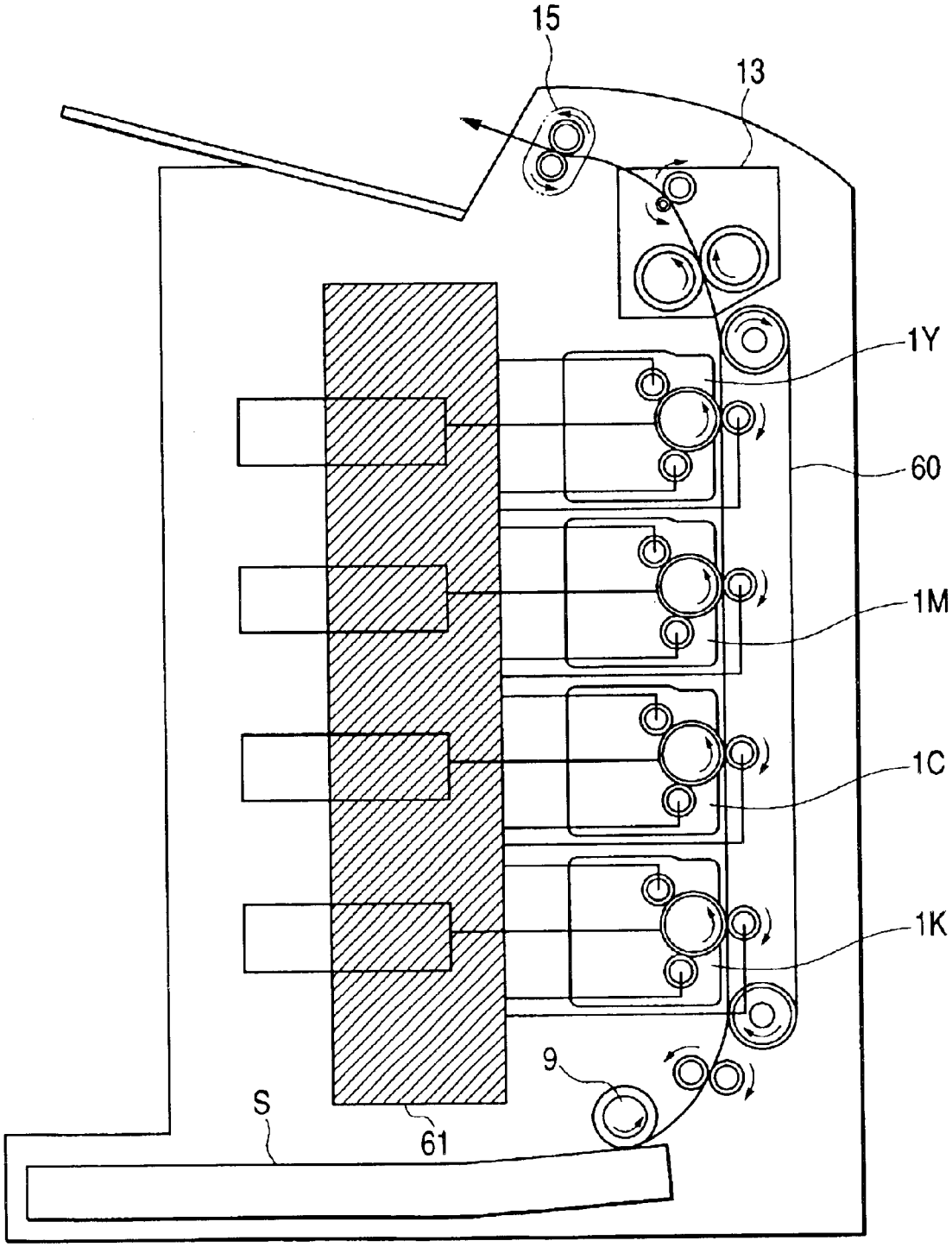
FIG. 7 is an entire constructural view of an image forming apparatus according to a second embodiment of the present invention.
Figure 8:
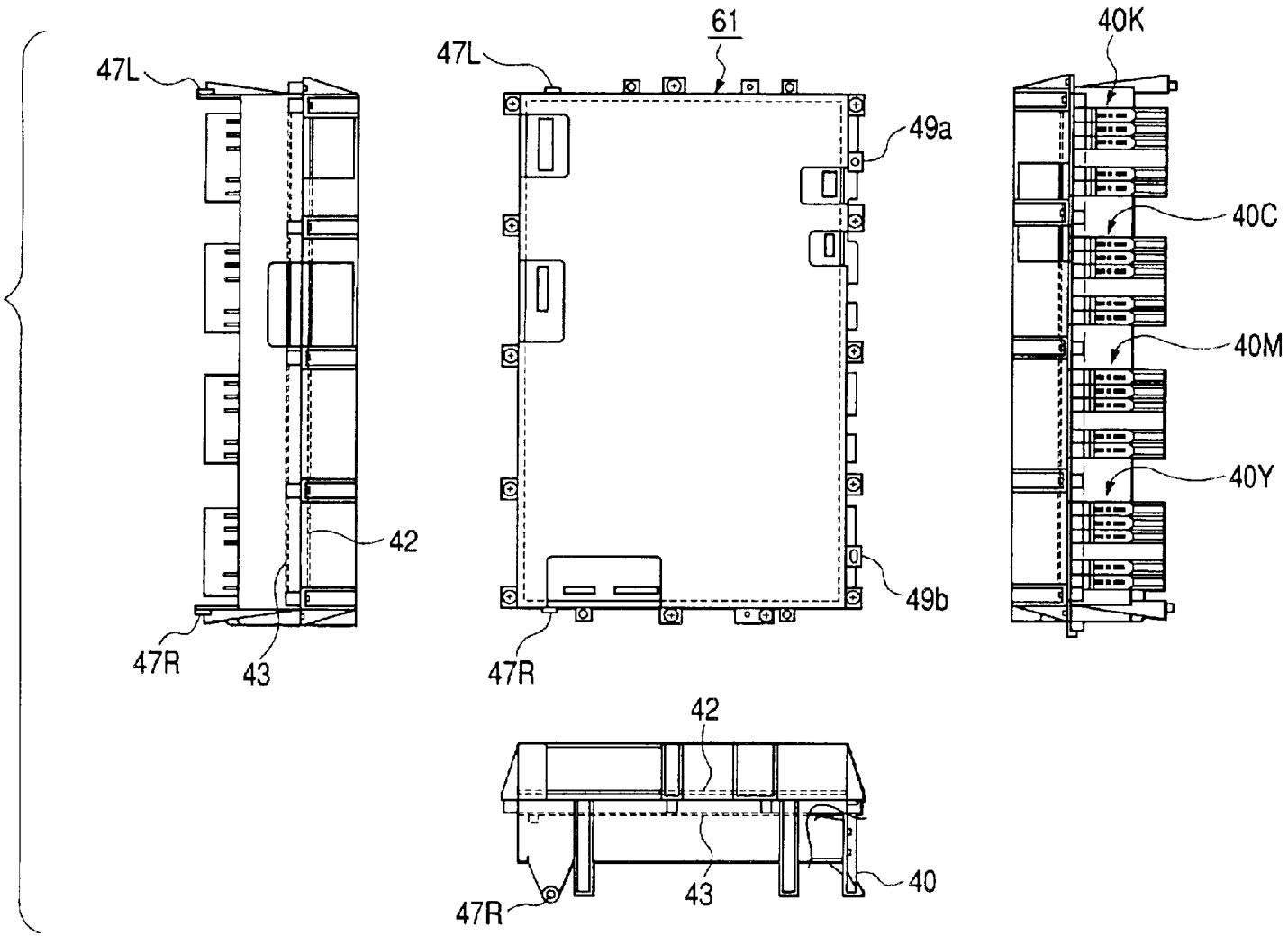
FIG. 8 is a view showing a high voltage unit according to the second embodiment.
Figure 9:
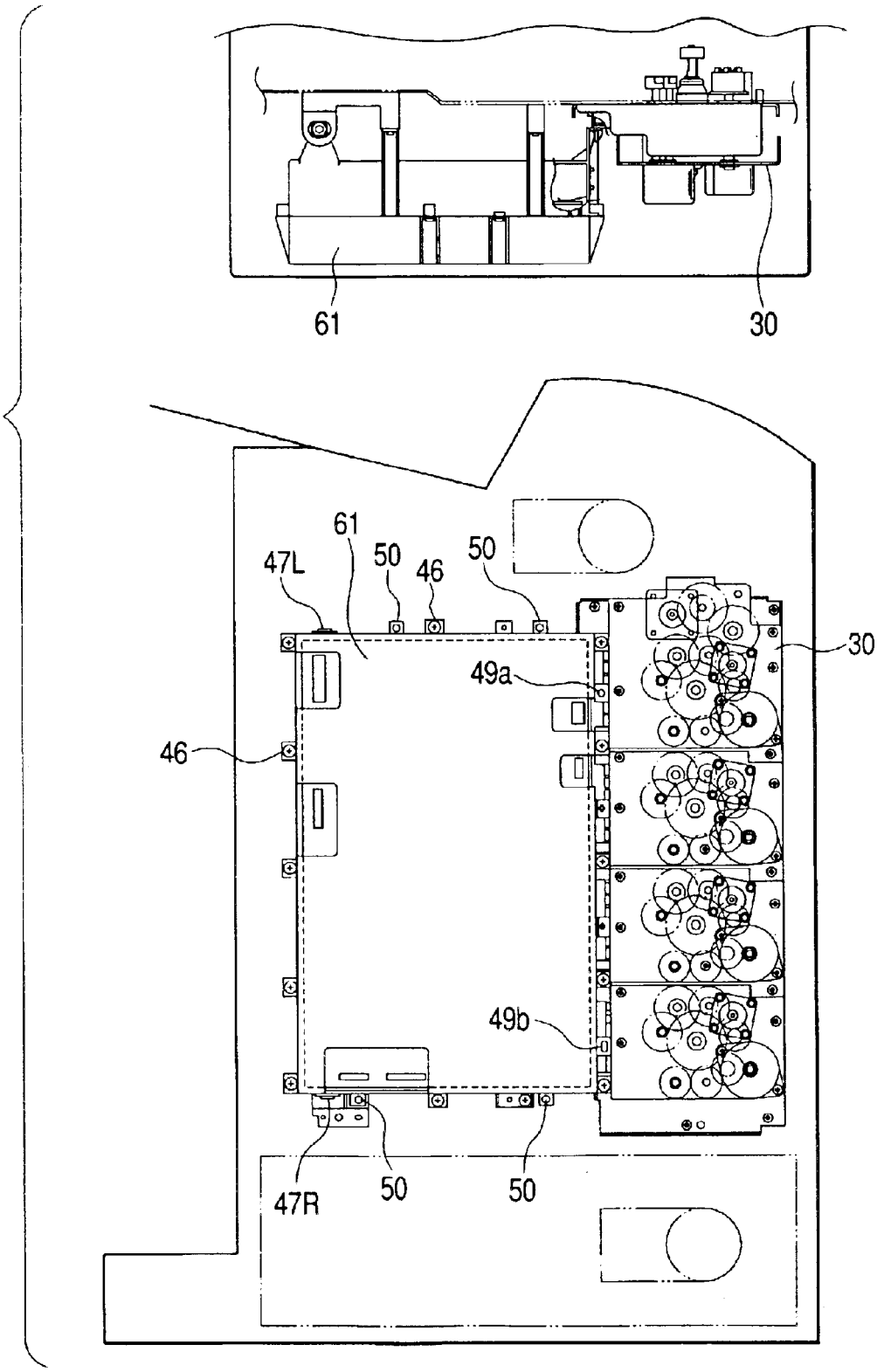
FIG. 9 is a view for explaining an assembled construction of a high voltage unit and a drive unit according to a third embodiment of the present invention.

A second embodiment of an image forming apparatus according to the present invention will now be explained with reference to the drawings. FIG. 7 is an entire constructural view of an image forming apparatus according to the second embodiment, FIG. 8 is a constructural view of a high voltage unit according to the second embodiment, and FIG. 9 is a view for explaining an assembled construction of the high voltage unit and a drive unit, according to the second embodiment. In these Figures, parts or elements similar to or same as those in the first embodiments are designated by the same reference numerals and explanation thereof will be omitted.

In the first embodiment, the image forming apparatus had the intermediate transferring belt 6 as the intermediate transferring body so that the sheet S was conveyed in the horizontal direction. To the contrary, in the second embodiment, the present invention is applied to an image forming apparatus having a transferring convey belt 60 for absorbing and conveying the sheet S and designed so that a sheet conveying path extends substantially vertically.

In the image forming apparatus having the above-mentioned arrangement, since there is provided no secondary transferring portion, as shown in FIG. 8, high voltage contacts are constituted by electrifying, developing and transferring contacts alone. Accordingly, a high voltage unit 61 has no secondary transferring contact spring 41 (refer to FIG. 2). With this arrangement, as shown in FIG. 9, although the rotary shafts 47R and 47L extend substantially vertically, similar to the first embodiment, since such direction is substantially perpendicular to the press-contact acting direction of the contacts, the high voltage unit 61 can similarly be assembled easily.

[Third Embodiment]

Figure 10:
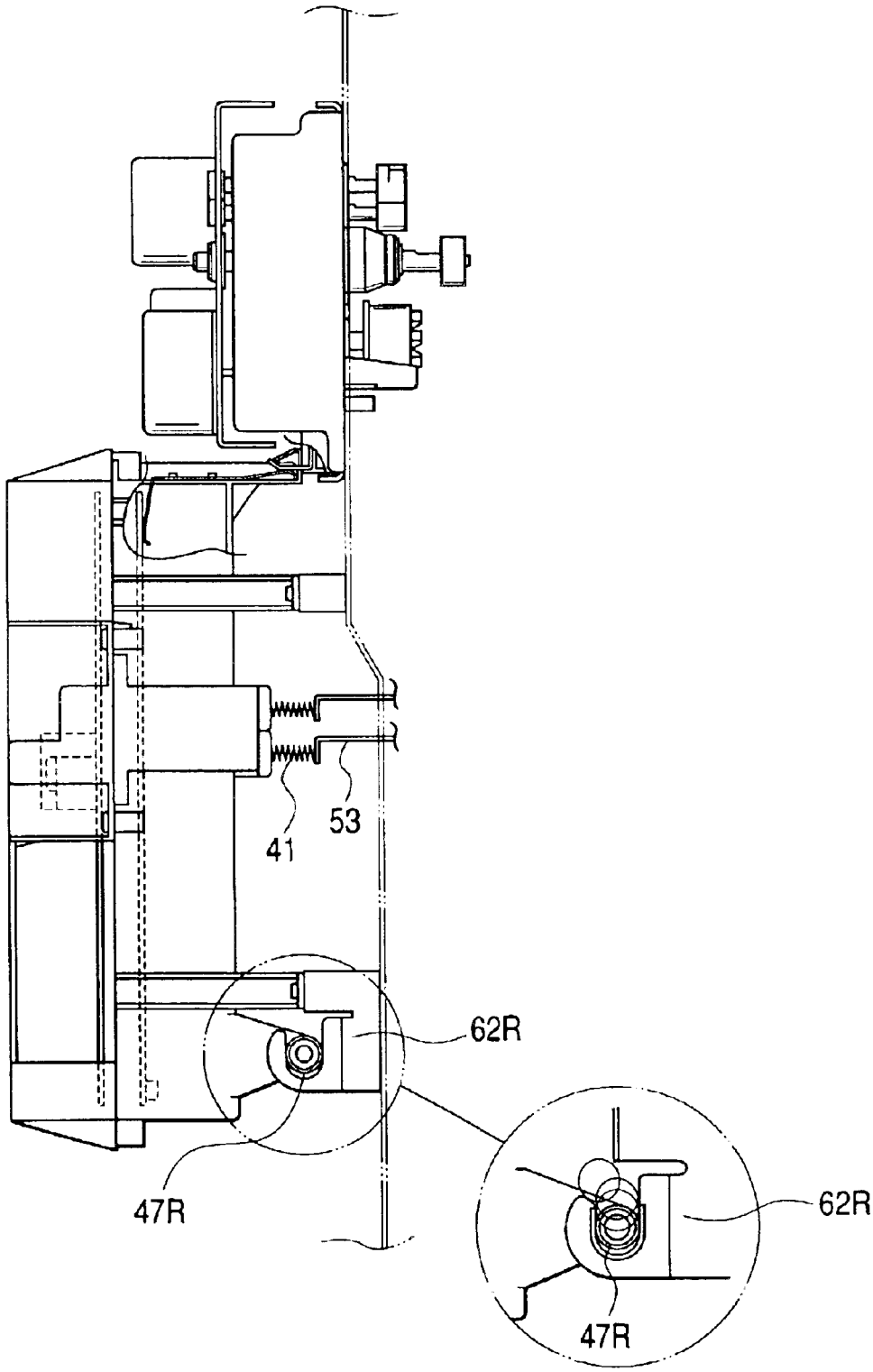
FIG. 10 is a view for explaining an assembled construction of the high voltage unit and the drive unit of an image forming apparatus according to the third embodiment.

A third embodiment of an image forming apparatus according to the present invention will be explained with reference to the drawings. FIG. 10 is a view for explaining an assembled construction of a high voltage unit and a drive unit of an image forming apparatus according to the third embodiment. In FIG. 10, parts or elements similar to or same as those in the first embodiment are designated by the same reference numerals and explanation thereof will be omitted.

In the first embodiment, although it was designed so that the rotary shaft supporting members 59R and 59L were provided with the holes to support the rotary shafts 47R and 47L, in the third embodiment, as shown in FIG. 10, rotary shaft supporting members 62 are provided with grooves in place of holes. With this arrangement, when the high voltage unit 31 is dropped as shown in FIG. 5A, the engaging lock effected by flexing the base portions of the rotary shafts 47R and 47L is not required, with the result that the operations are more facilitated.

[Fourth Embodiment]

Figure 11:
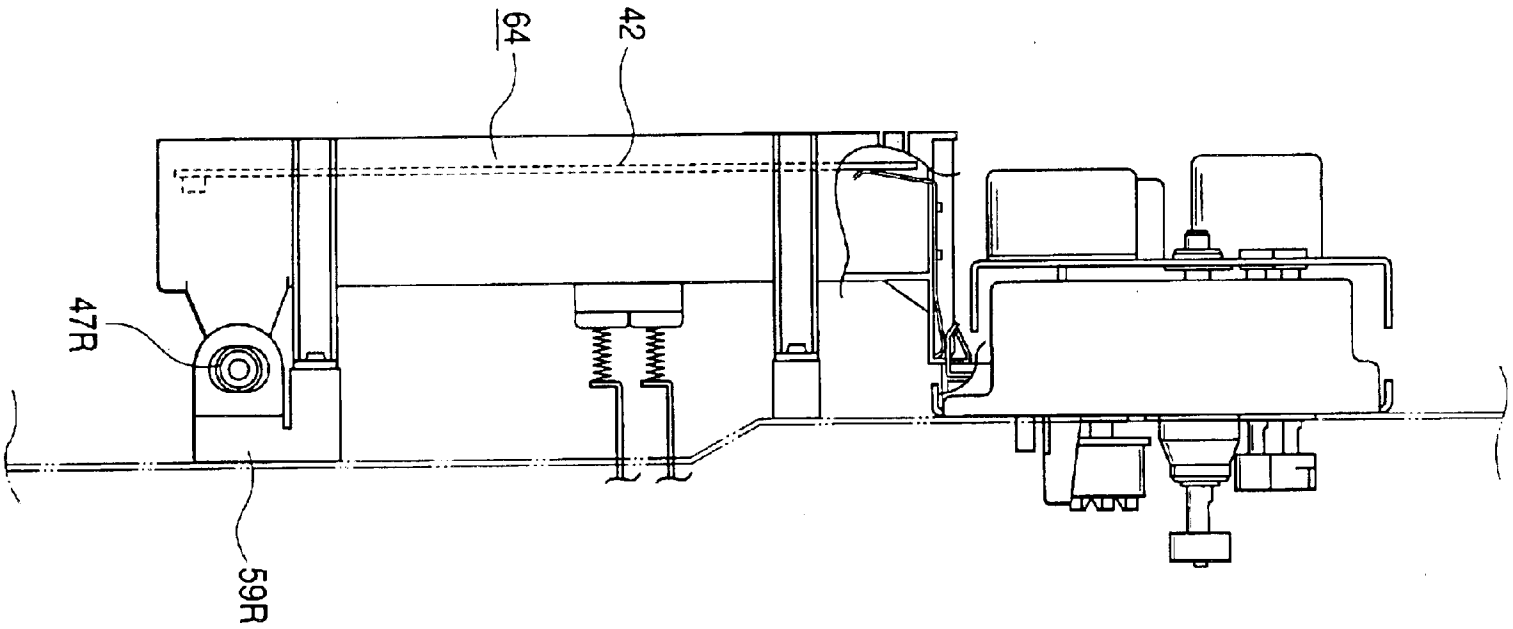
FIG. 11 is a view for explaining an assembled construction of a high voltage unit and a drive unit of an image forming apparatus according to a fourth embodiment of the present invention.

A fourth embodiment of an image forming apparatus according to the present invention will be explained with reference to the drawings. FIG. 11 is a view for explaining an assembled construction of a high voltage unit and a drive unit of an image forming apparatus according to the fourth embodiment. Parts or elements similar to or same as those in the first embodiment are designated by the same reference numerals and explanation thereof will be omitted.

FIG. 11 shows a construction example in which a single high voltage circuit substrate 42 is provided within a high voltage unit 64. With this arrangement, necessary for considering separate mounting/dismounting of the internal substrate is little, the high voltage unit 64 does not have a dividable construction. Incidentally, it should be noted that a circuit substrate could be laminated and secured onto the aforementioned high voltage circuit substrate via supporting members such as appropriate spacers.

[Fifth Embodiment]

Figure 12:
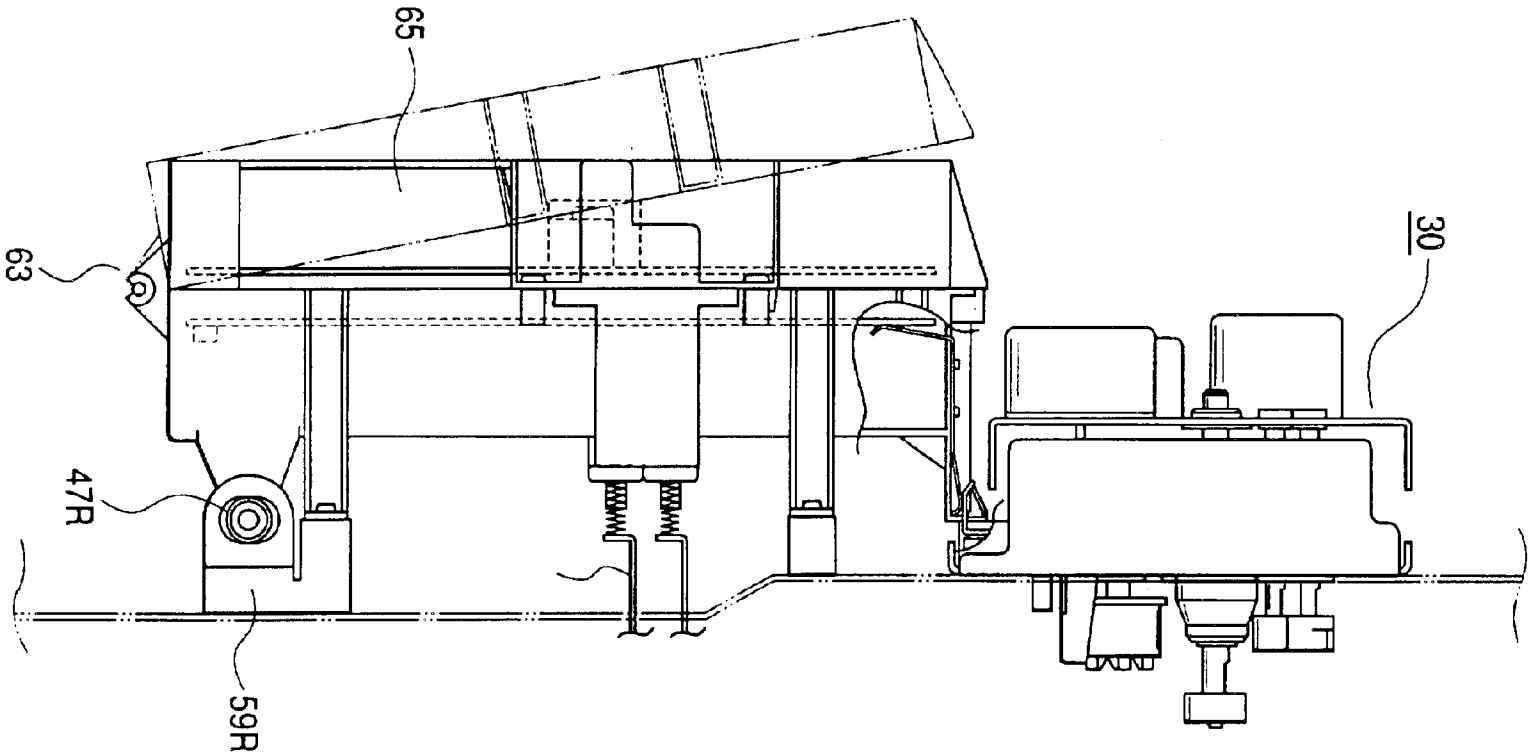
FIG. 12 is a view for explaining an assembled construction of a high voltage unit and a drive unit of an image forming apparatus according to a fifth embodiment of the present invention.
Figure 13:
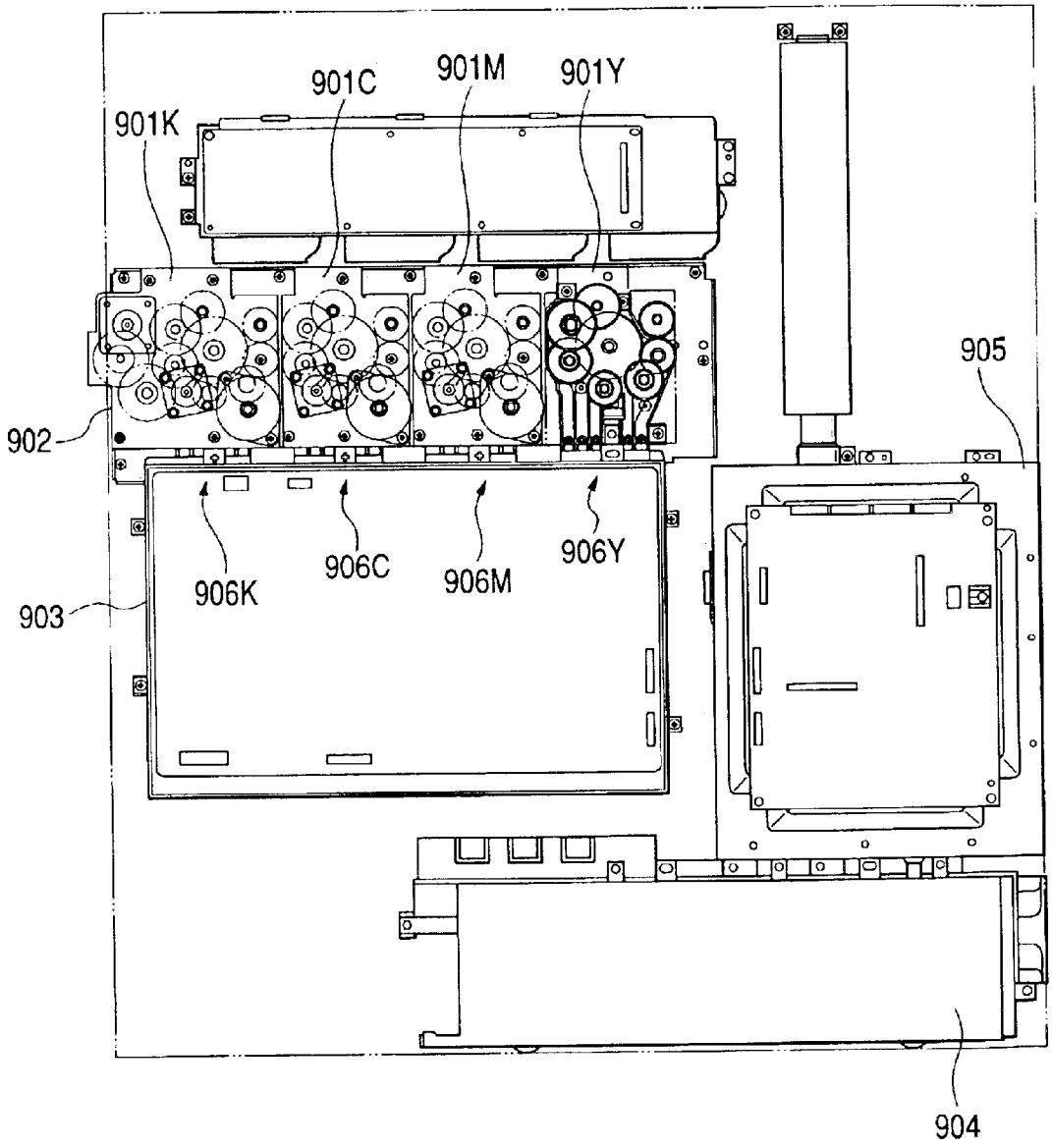
FIG. 13 is a view for explaining an assembled condition of a conventional high voltage unit to an apparatus main body.
Figure 14:
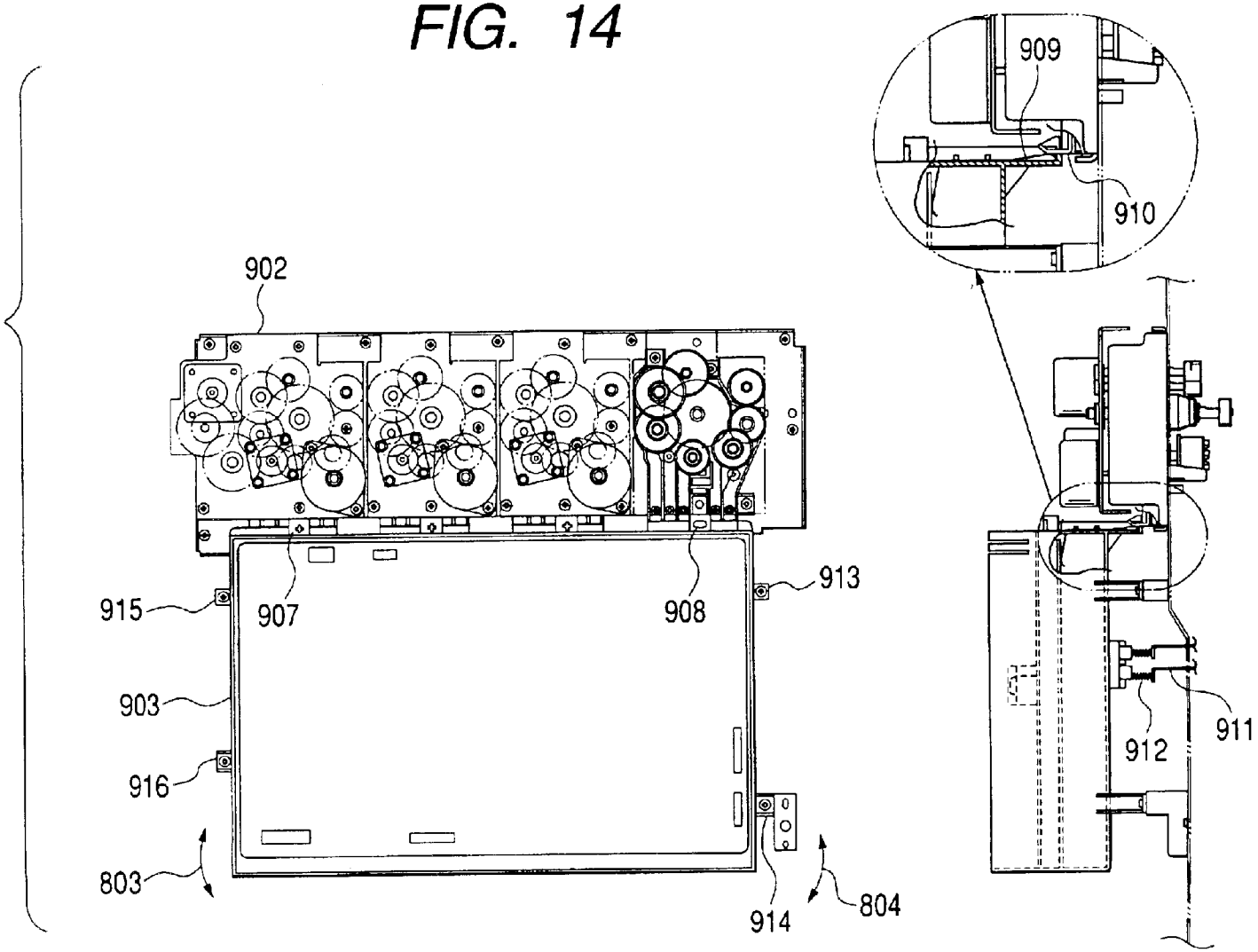
FIG. 14 is a view for explaining an assembled construction of the conventional high voltage unit and a drive unit.

A fifth embodiment of an image forming apparatus according to the present invention will be explained with reference to the drawings. FIG. 12 is a view for explaining an assembled construction of a high voltage unit and a drive unit of an image forming apparatus according to the fifth embodiment. Parts or elements similar to or same as those in the first embodiment are designated by the same reference numerals and explanation thereof will be omitted.

FIG. 12 shows an arrangement in which laminated high voltage circuit substrates 42 and 43 are provided similar to the first embodiment and a rotary member (hinge) 63 is provided at a separating/fastening portion of a high voltage unit 65. With this arrangement, in a condition that the high voltage unit 65 is attached to the apparatus main body, mounting/dismounting of the internal high voltage circuit substrates 42 and 43 is more facilitated, thereby enhancing operability.

Incidentally, in the above-mentioned embodiments, although the arrangement in which the high voltage unit is connected to the drive unit by using the high voltage contacts 40 comprised of the leaf springs and the contact plates was explained, even when other connecting method is used, for example, when compression coil springs and connectors are used, the present invention is effective in the arrangement in which many contacts are contacted simultaneously. Incidentally, when the compression coil springs are used, the secondary transferring contact portion 53 can be fitted in a parallel direction with respect to the press-contact acting direction of the contacts. Further, although the example in which the present invention is applied to the high voltage unit was explained, the present invention can similarly be applied to other electric component units.

What is claimed is:

1. An image forming apparatus comprising:

an apparatus main body having a contact; and an electric component unit including a circuit substrate and a contact electrically connected to said circuit substrate, said electric component unit being mountable and dismountable with respect to said apparatus main body, wherein (i) when said electric component unit is mounted to said apparatus main body, a part of said electric component unit is engaged to said apparatus main body and becomes movable by making the part act as a pivot; and wherein (ii) when said electric component unit is moved around said pivot, the contact of said electric component unit approaches the contact of said apparatus main body, and (iii) when said electric component unit is further moved, thereby the contact of said electric component unit is electrically connected to the contact of said apparatus main body.

2. An image forming apparatus according to claim 1, wherein said pivot comprises a hinge mechanism.

3. An image forming apparatus according to claim 2, wherein said electric component unit has a plurality of contacts arranged in a direction parallel to the axis of a rotary shaft of said hinge mechanism.

4. An image forming apparatus according to claim 1, wherein said electric component unit has positioning means for positioning said electric component unit with respect to said apparatus main body, and said positioning means is provided in the vicinity of said contact of said electric component unit.

5. An image forming apparatus according to claim 1, wherein said electric component unit comprises a first frame and a second frame, and a first circuit substrate mounted on said first frame and a second circuit substrate mounted on said second frame, wherein said first frame and said second frame can be divided in a laminating direction of said first and second circuit substrates, and wherein a first contact of said first circuit substrate and a second contact of said second circuit substrate are released when said first frame and said second frame are divided, and said first contact of said first circuit substrate and said second contact of said second circuit substrate are contacted when said first frame and said second frame are assembled.

6. An image forming apparatus according to claim 5, wherein said first frame and said second frame are divided by a second hinge mechanism different from a first hinge mechanism of said pivot which engages said apparatus main body to said electric component unit.

7. An image forming apparatus comprising:

an apparatus main body; and an electric component unit mountable and dismountable with respect to said apparatus main body, said electric component unit comprising a first frame and a second frame, and a first circuit substrate mounted on said first frame and a second circuit substrate mounted on said second frame, wherein said first frame and said second frame can be divided in a laminating direction of said first and second circuit substrates, and wherein a first contact of said first circuit substrate and a second contact of said second circuit substrate are released when said first frame and said second frame are divided, and said first contact of said first circuit substrate and said second contact of said second circuit substrate are contacted when said first frame and said second frame are assembled.

8. An image forming apparatus according to claim 7, wherein said first frame and said second frame are divided by a second hinge mechanism different from a hinge mechanism engaging said apparatus main body to said electric component unit.

* * * * *

UNITED STATES PATENT AND TRADEMARK OFFICE

CERTIFICATE OF CORRECTION

PATENT NO. : 6,853,819 B2
DATED : February 8, 2005
INVENTOR(S) : Sugita

It is certified that error appears in the above-identified patent and that said Letters Patent is hereby corrected as shown below:

Column 2,
Line 12, “that” should read -- that it --.

Column 3,
Lines 17, 24 and 26, “constructural” should read -- structural --.

Column 4,
Line 3, “constructural” should read -- structural --.
Line 17, “abbreviation” should read -- abbreviations --.
Line 20, “or” should be deleted.
Line 21, “Y to K” should be deleted.
Line 39, “synchronous” should read -- synchronism --.

Column 5,
Line 15, “respectively” should read -- respectively, --.
Line 16, “are” should be deleted.

Column 6,
Line 31, “escaped,” should read -- avoided, --.
Line 62, “is” should read -- which is --.

Column 7,
Line 29, “Inventors,” should read -- inventors, --.

Column 8,
Line 14, “construc-” should read -- struc- --.
Line 16, “constructural” should read -- structural --.
Line 29, “convey” should read -- conveyor --.

Column 9,
Line 57, “pivot;” should read -- pivot, --.
Line 60, “and” should be deleted.

UNITED STATES PATENT AND TRADEMARK OFFICE

CERTIFICATE OF CORRECTION

PATENT NO. : 6,853,819 B2
DATED : February 8, 2005
INVENTOR(S) : Sugita

It is certified that error appears in the above-identified patent and that said Letters Patent is hereby corrected as shown below:

Column 10,
Line 1, “and (iii)” should read -- and -- and “wherein (iii)” should begin a new paragraph.

Signed and Sealed this

Third Day of January, 2006

JON W. DUDAS
*Director of the United States Patent and Trademark Office*